United States Patent [19]

Nagase

[11] 4,075,734

[45] Feb. 28, 1978

[54] DOOR CLOSER

[75] Inventor: Tosiro Nagase, Sagamihara, Japan

[73] Assignee: Tokico Ltd., Japan

[21] Appl. No.: 707,290

[22] Filed: Jul. 21, 1976

[51] Int. Cl.[2] ..... E05F 3/22

[52] U.S. Cl. ..... 16/58; 16/DIG. 9; 16/DIG. 10

[58] Field of Search ..... 16/58, DIG. 10, 51, 16/52, DIG. 9, 66

[56] References Cited

U.S. PATENT DOCUMENTS

| | | | |
|---|---|---|---|
| 1,799,872 | 4/1931 | Seipel | 16/51 X |
| 3,137,888 | 6/1964 | Blom | 16/56 X |
| 3,497,904 | 3/1970 | Merayo | 16/52 |
| 3,584,331 | 6/1971 | D'Hooge | 16/51 X |

*Primary Examiner*—Werner H. Schroeder
*Assistant Examiner*—Conrad L. Berman
*Attorney, Agent, or Firm*—Wenderoth, Lind & Ponack

[57] ABSTRACT

A door closer has an inner cylinder receiving a piston slidably therein, an outer cylinder surrounding the inner cylinder to define a space therebetween, which space communicates with the interior of the inner cylinder at the opposite ends thereof, a piston rod extending from the piston out of one end of the inner cylinder and for connection to a door to urge it to the closed position, a valve mechanism disposed in the other end of the inner cylinder to control oil flow between the interior of the inner cylinder and the space. The door closer is mounted horizontally and a portion of the space is filled with high pressure gas.

4 Claims, 5 Drawing Figures

DOOR CLOSER

DESCRIPTION OF THE INVENTION

This invention relates to a door closer for automatically closing an opened door.

Door closers of the prior art usually include one or more metal springs therein to generate a door closing force from the elastic restoring force in the spring or springs. As a result, the door closing force is limited by the range of elastic deformation of the metal spring, so that application of the door closer is limited to a relatively narrow range. In addition, since the metal spring is enclosed within a sealed casing, it has been very difficult to adjust the door closing force of the door closer.

The present invention provides a door closer which overcomes the aforesaid shortcomings. According to the present invention, there is provided a door closer in which oil and pressurized gas are provided in the door closer comprising an inner cylinder receiving a piston slidably therein, a coaxial outer cylinder surrounding the inner cylinder, and an annular space defined between the inner and the outer cylinders with a portion thereof acting as a gas chamber.

Preferably, a bulged or large diameter portion is formed in the outer cylinder so as to define a gas chamber therein when the door closer is located horizontally, thus preventing gas from flowing into the inner cylinder.

These and further objects and effects of the present invention will now be described in more detail in conjunction with the accompanying drawings which illustrate preferred embodiments of the present invention, in which.

Figure 1:
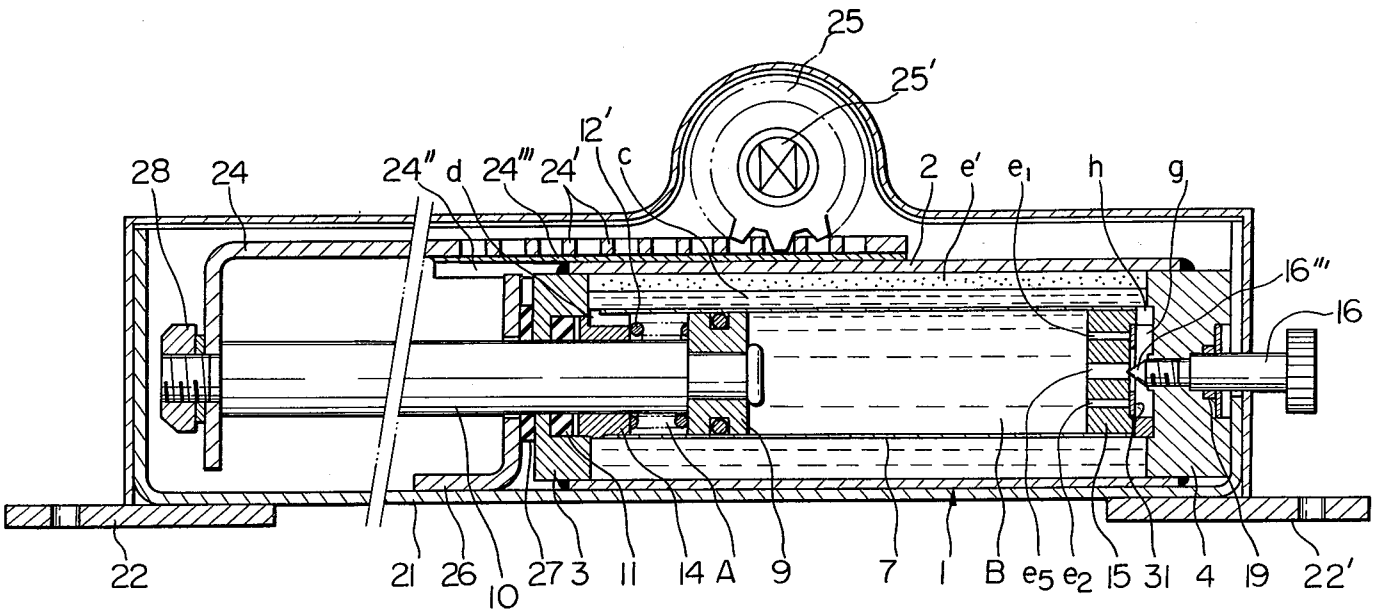
FIG. 1 is a partially broken longitudinal cross-sectional view of a door closer according to the present invention.
Figure 2:
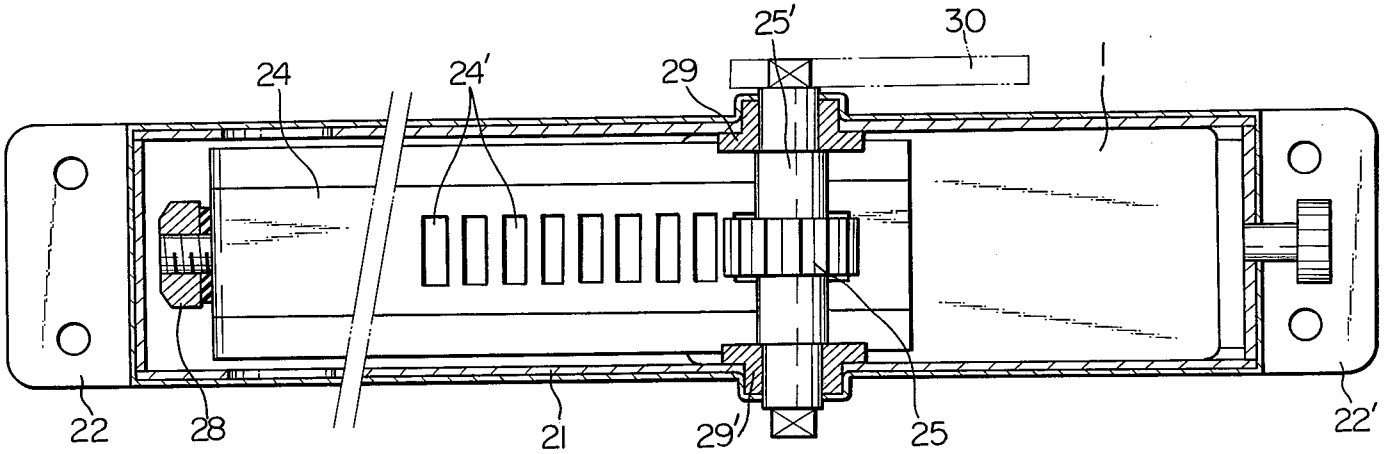
FIG. 2 is a partially cross-sectional plan view of the door closer of FIG. 1.

In FIGS. 1 and 2 illustrating a door closer according to the present invention, a casing 21 having attaching brackets 22 and 22' secured thereto at the opposite ends thereof encloses drive and damping means 1 and drive force transmitting means 24 and 25 therein. The drive and damping means 1 is mounted in the casing 21 by a bracket 26 secured to the casing 21 and having a packing 27 such as rubber sheet or the like thereon. A rod 10 projects from one end of the drive and damping means 1, and an actuating plate 24 is secured to the projecting end of the rod 10 by a nut 28. Rack teeth 24' are formed in the plate 24 for cooperating with a pinion 25. A shaft 25' of the pinion 25 is supported on the casing 1 in bearings 29 and 29' and one end of the shaft 25' projects outwardly of the casing 1 for mounting thereon of an actuating arm one end of which is connected to a door (not shown).

The drive and damping device 1 comprises an inner cylinder 7 and a coaxial outer cylinder 2 spaced therefrom, and the opposite ends of the outer cylinder 2 are closed by end plates 3 and 4. A piston 9 secured to the inner end of the rod 10 is slidably fitted in the inner cylinder 7. The inner and the outer cylinders define an annular chamber therebetween, and the upper portion e' of which is filled with pressurized gas, preferably air, to constitute a gas chamber. The remaining portion c of the annular chamber and the interior of the inner cylinder is filled with oil.

When the rod 10 moves into the cylinder 7 the volume of the gas chamber e' varies accordingly with a resulting variation in its pressure. A drive force corresponding to the pressure multiplied by the cross-sectional area of the rod 10 will act as a door closing force. In this respect, an oil space A defined in the inner cylinder 7 on the left side of the piston 9 communicates through a passage d with the oil space C, the passage d is being a cutout portion in an end plug 14 closing and supporting one end of the inner cylinder 7. An oil space B defined in the inner cylinder 7 on the right side of the piston 9 communicates with the oil space C through passages $e_1$, $e_2$, $e_5$, $g$, and $h$, the passages $e_1$, $e_2$ and $e_5$ being formed in an end plug 15 closing and supporting the right end of the cylinder 7, and the passage $g$ being an axial recess in the plug 15 and the passage $h$ a cutout portion of the plug 15. When the rod 10 moves in the door opening direction, namely, the rightward direction in FIG. 1, a plate valve 31 disposed in the axial recess of the plug 15 moves rightward to open the passages $e_1$ and $e_2$ (in this respect, there may be arranged in the plug 15 further passages for example $e_3$ and $e_4$) for attaining relatively free oil flow from the space B to the space C. But when the rod 10 moves in the opposite direction, the valve 31 closes the passages $e_1$ and $e_2$, thus, oil is restricted in its flow from the space C to the space B through the passage $e_5$, the area of which can be adjusted by an adjusting screw 16. By this means, the door closing speed can be adjusted.

A spring 12' is disposed between the end plug 14 and the piston 9 and is compressed when the piston 9 approaches the end of the leftward movement (door closing stroke) so as to reduce the door closing speed at the end of the stroke.

With the door closer having the aforesaid arrangement when the door is opened, the rod 10 moves rightward in FIG. 1 which shows the door closer in the door closed position, and gas in the gas chamber $e'$ is compressed in response to the ingress of the rod 10 into the cylinder 7, whereby an energy is stored in the drive and damping means 1. Oil flows from the space B to the space C through passages $e_1$, $e_2$, $e_5$, $g$ and $h$ and from the space C to the space A through the passage $d$ without causing any substantial damping force. Thereafter the door closes automatically by the energy stored in the pressurized gas in the drive and damping means 1 which moves the piston and the rod leftwardly. A damping force is generated by the oil flowing through the restricted passage $e_5$.

In the door closer shown in the drawing, the rod 10 is sealed by a seal 11 against oil leakage and the adjusting screw 16 is sealed by a seal 19. Further it will be noted that the actuating plate 24 is slidably supported on the outer periphery of the outer cylinder 2, and for this end, the plate 24 has arcuate skirt portions 24'' for engaging with the outer periphery of the cylinder 2, and a suitable bearing plate 24'' is interposed therebetween. Thus reliable engagement is assured between the racks 24' and the pinion 25.

Figure 3:
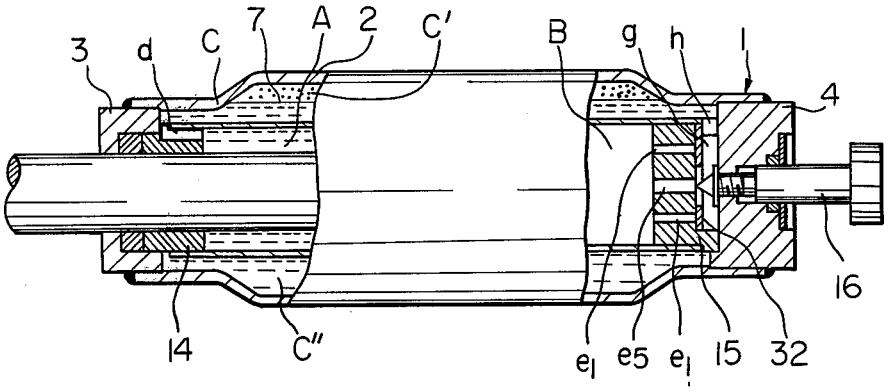
FIG. 3 is a longitudinal cross-sectional view of an essential portion of a door closer of a modified form.

The drive and damping means 1 shown in FIG. 3 is similar to that of the first embodiment, but the outer cylinder 2 is modified to have a large diameter portion or bulged portion of substantial length between the ends so as to define a gas chamber C′ therein with a sufficient volume and remote from the passages $e_1$ and $h$. This embodiment is effective in preventing gas in the gas chamber from being carried into the inner cylinder when the door closer is actuated quickly, and also provides a large supporting area for the actuating plate (not shown). In this respect, the bulged portion of the outer cylinder may have a cross-section such that only the upward portion is bulged to define the gas chamber therein.

Figure 4:
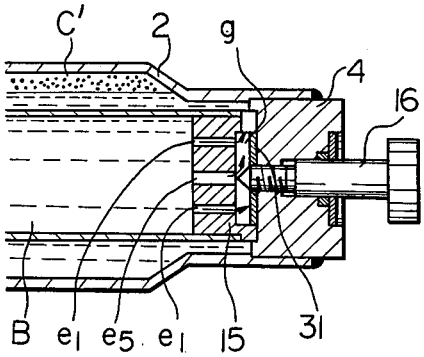
FIG. 4 is a view of a portion of the door closer of FIG. 3 showing operation of oil passage adjusting device.

FIG. 4 shows a portion of the door closer of FIG. 3 when the piston and the rod (not shown) are moving in the door opening direction in which the plate valve 31 is moved to open the passages $e_1$, while in FIG. 3 the passages $e_1$ are closed by the plate 32 and the rod is moving leftward or the door closing direction. In this respect, a light spring (not shown) is preferably disposed between the plate 31 and the end plate 4 so as to urge the valve plate 31 toward the position shown in FIG. 3.

Figure 5:
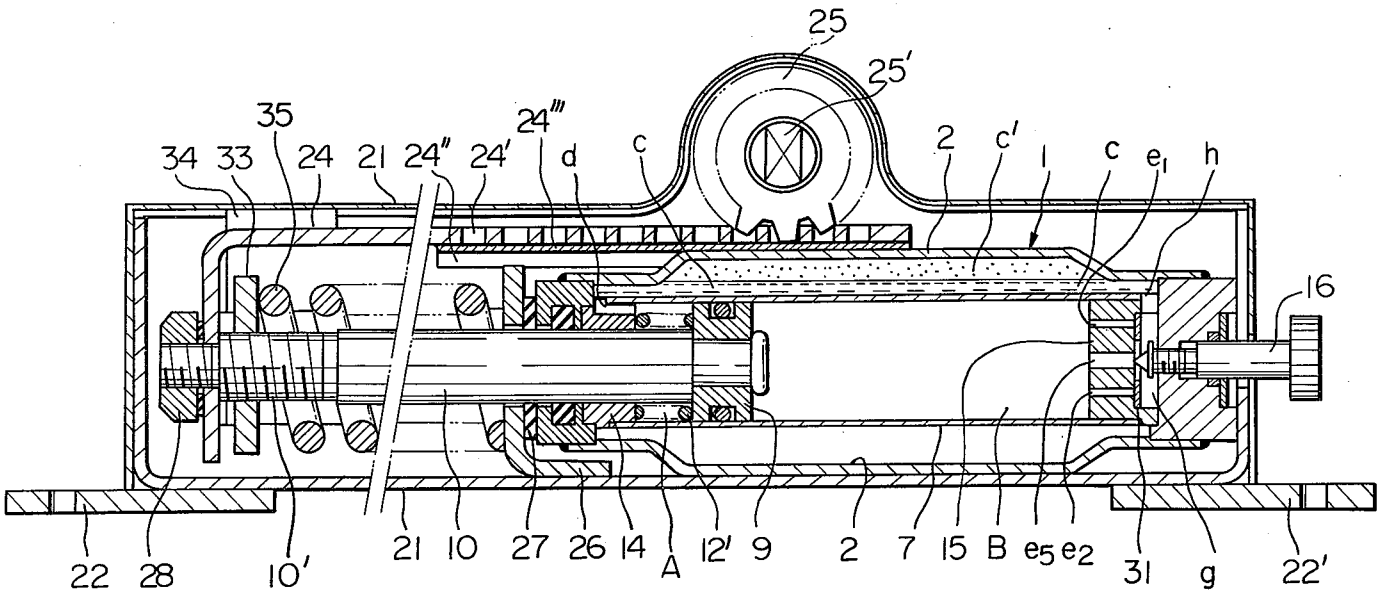
FIG. 5 is a longitudinal cross-sectional view of another embodiment of the present invention.

FIG. 5 shows another embodiment of the present invention, in which an external spring 35 is disposed between a bracket 26 mounting the drive and damping means 1 in the casing 1 and an adjusting plate 33 threadingly engaging with the rod 10 for assisting the door closing force stored in the pressurized gas in the drive and damping means 1. The spring force of the spring 35 may be adjusted by rotating the adjusting plate 35 on the rod 10 by inserting a suitable tool (not shown) through an opening 34 formed in the casing 21. The construction and operation of the door closer is otherwise similar to that of the door closer of FIGS. 1 and 2.

What is claimed is:

1. A door closer comprising a horizontally disposed inner cylinder, a piston slidable in the inner cylinder, an outer cylinder surrounding the inner cylinder and spaced therefrom for defining an annular space therebetween, the wall of the inner cylinder having holes therein at the opposite ends thereof connecting the interior of the inner cylinder with said annular space, a piston rod extending from said piston out through one end of the cylinders and being adapted to operate a door for moving the door in the closing direction when the rod moves out of the cylinder, hydraulic fluid filling the interior of said inner cylinder, said holes and a part of said annular space, a high pressure gas filling the remaining part of said annular space, and resisting force generating means in the flow path of the hydraulic fluid from the other end of the inner cylinder to the outer cylinder for generating a resisting force to flow of hydraulic fluid when the rod moves in the door closing direction.

2. A door closer as claimed in claim 1 wherein said outer cylinder has a bulged portion at least in the upper portion thereof with a substantial length in the direction between the opposite ends of the outer cylinder.

3. A door closer as claimed in claim 1, wherein said door closer further comprises an actuating plate having rack teeth thereon, said actuating plate extending in the direction of the axis of said inner cylinder and being secured to the end of the rod projecting out of said inner cylinder, and a pinion meshing with the rack teeth on said actuating plate.

4. A door closer as claimed in claim 3 wherein said actuating plate is slidably supported on the outer periphery of the outer cylinder.

* * * * *